United States Patent [19]

Wikström et al.

[11] Patent Number: 4,747,238

[45] Date of Patent: May 31, 1988

[54] TERRACE INSTALLATION

[75] Inventors: Ulf Wikström, Alnö ; Ruben Madsen, Sundsvall, both of Sweden

[73] Assignee: Sit Down Aktiebolag, Sundsvall, Sweden

[21] Appl. No.: 10,132

[22] PCT Filed: Apr. 18, 1986

[86] PCT No.: PCT/SE86/00179

§ 371 Date: Dec. 31, 1986

§ 102(e) Date: Dec. 31, 1986

[87] PCT Pub. No.: WO86/06433

PCT Pub. Date: Nov. 6, 1986

[30] Foreign Application Priority Data

Apr. 30, 1985 [SE] Sweden ..... 8502099

[51] Int. Cl.[4] ..... E04H 3/12

[52] U.S. Cl. ..... 52/8; 297/243

[58] Field of Search ..... 52/6–10, 52/189; 297/243; 108/159

[56] References Cited

U.S. PATENT DOCUMENTS

| | | | |
|---|---|---|---|
| 1,715,885 | 6/1929 | Annand et al. | 52/8 |
| 1,839,679 | 1/1932 | Hoppes | 297/243 |
| 2,186,866 | 1/1940 | Hussey | 297/243 |
| 2,524,769 | 10/1950 | Blair et al. | 52/189 |
| 4,345,406 | 8/1982 | Motley | 108/159 |

FOREIGN PATENT DOCUMENTS

| | | |
|---|---|---|
| 1805755 | 3/1979 | Fed. Rep. of Germany . |
| 73676 | 3/1930 | Sweden . |
| 206022 | 7/1962 | Sweden . |
| 424210 | 7/1982 | Sweden . |

*Primary Examiner*—James L. Ridgill, Jr.

*Attorney, Agent, or Firm*—Murray and Whisenhunt

[57] ABSTRACT

Portable terrace installation with seats, including one or more sections, each section comprising a pair of sloping joists and a number of upright seating beam pillars connected to the sloping joists. A corresponding number of parallel and horizontal seating beams connected to the pillars are provided and extend between opposite beam pillars on the pair of joists. Each seating beam has opposite ends and has a height which is greater than its width. A flat floor surface extends between the seating beams and is connected to the joists, and a number of free standing trestles are provided for supporting the joists. A first connecting element is provided on the side of the beam pillar facing the seating beam, with the first connecting element extending essentially vertically along that side. The first connecting element has a length essentially as long as the height of the seating beam or longer, and the first connecting element comprises a female member open at an upper end thereof and being terminated by a support surface. A second connecting element is connected to each end of the seating beam and is essentially vertical. The second connecting member comprises a male member having a height essentially the same as the height of the seating beam, and the first and second connecting elements are connectable to join a seating beam with opposite beam pillars without a wedge effect between the male and female members until the male member rests against the support surface of the female member. The male member includes a sideways extending waist member terminating with a widened portion for preventing the seating beam and the beam pillar from separating from each other due to tractive forces on the seating beam or sideways effects on the beam pillars or joists.

11 Claims, 10 Drawing Sheets

Fig.9.
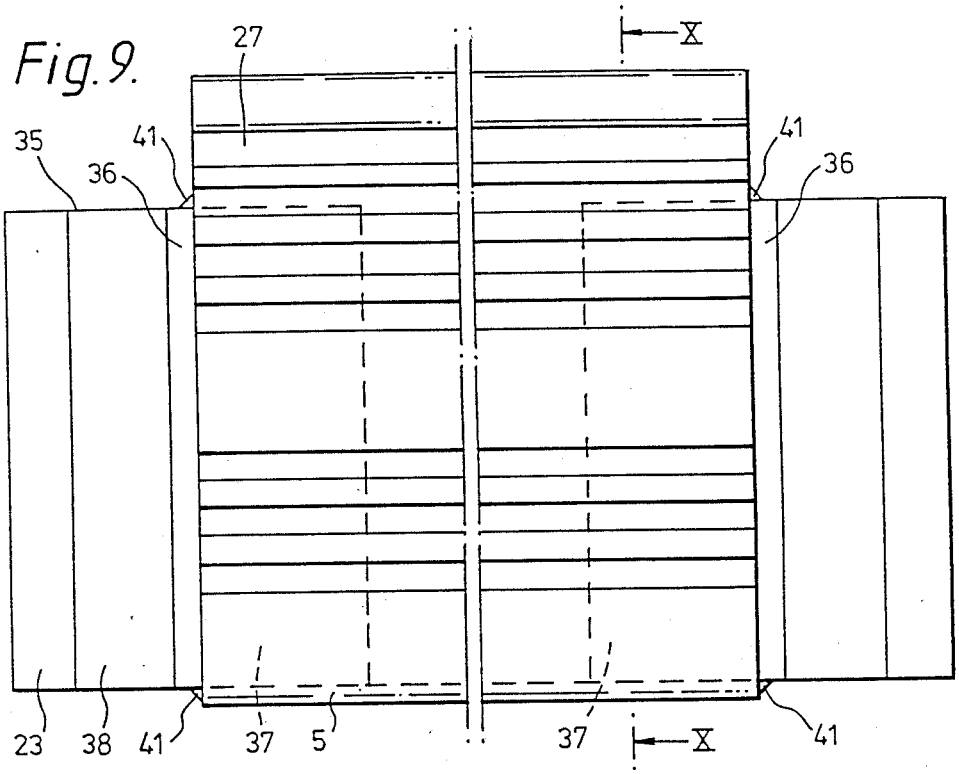
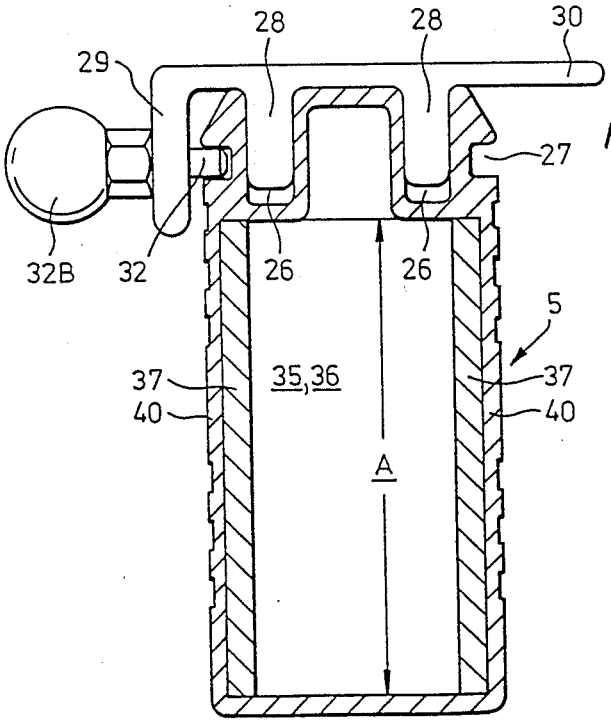
Fig.10.
Fig.15.
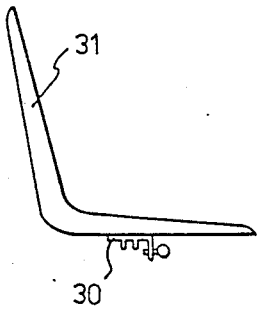

Fig.11.
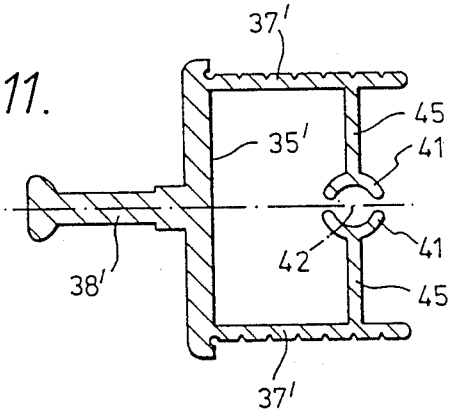
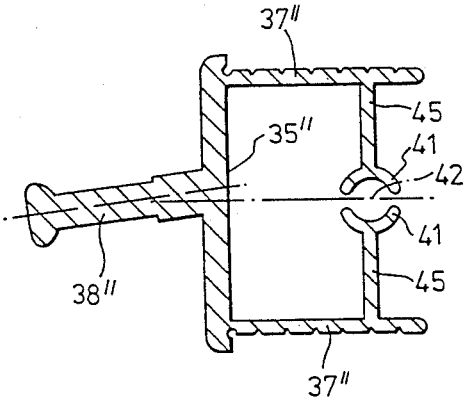
Fig.12.
Fig.13.
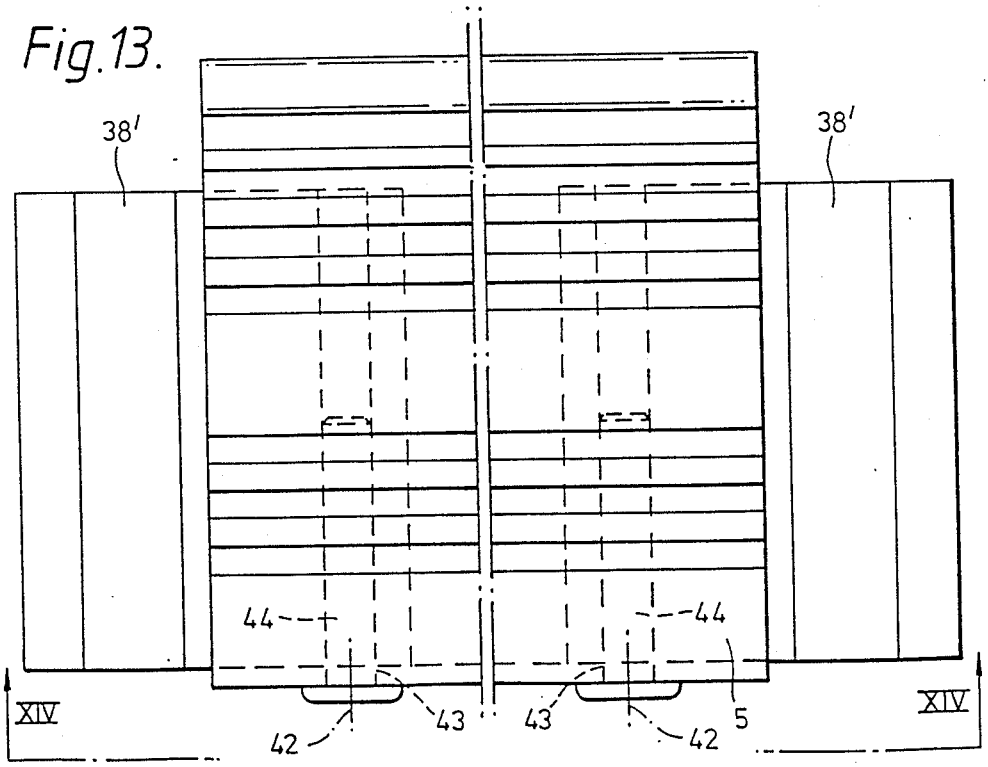

TERRACE INSTALLATION

TECHNICAL FIELD

The invention concerns a terrace installation with seats a so-called gradin system, for spectators in theatre premises and circuses, at sports grounds, open air theatres and the like. The installation comprises in each section, a pair of sloping joists, each one with a number of vertical seating beam pillars, a corresponding number of parallel and horizontal seating beams which are mounted on the pillars and which stretch between opposite seating beam pillars on the hard joists, also a flat floor surface between each pair of parallel seating beams.

BACKGROUND OF THE INVENTION

Spectator stands or terrace installations with seats, the so-called gradin system, are generally permanent. They are usually made of wood, steel or concrete construction. In certain cases they are made of prefabricated elements, which are assembled on the site. Examples of such permanent tier systems are described in Swedish patent specifications 73 676 and 206 022 and also in U.S. Pat. No. 2,524,769.

However, installations are often needed which can be quickly set up and dismantled and which consist of portable parts. For example in circuses such systems have been used for a long time. The constituent elements, are often very heavy. Its is desirable that no element should weigh more than 20 to 25 kg. The greatest weakness is, however, that the joints are not reliable. In general they use connecting elements of the types with hooks and eyes, pins, ball and socket joints, screws and nuts and the like. A disadvantage of such connecting elements is that they can slacken (there is no screw connection that is completely safe) and come apart during handling. In addition the usual systems are more or less unstable. Furthermore they are often troublesome to erect. An example of a portable stand or gradin system intended to be assembled with the aid of pins is the construction which is described in Swedish patent specification No. 424 210.

SUMMARY OF THE INVENTION

The purpose of the invention is to offer a portable so-called gradin system, which is easy to erect and dismantle, that is to say a terrace installation with seats, which is not based on the use of screws, nuts, pins or the like or on the use of connecting elements which in their turn are fastened to a load-bearing member with the aid of screws or the like for assembly of the system's basic elements for a coherent system. More precisely the invention aims to offer a system in which the constituent parts are assembled so as to be self-locking. By self-locking it is here not only understood that the need for such measures as bolting, securing of pins and the like is eliminated but also that the locking effect becomes greater the greater the load on the gradin system becomes under the effect of the weight of the spectators, without the elements at the same time being wedged tight into each other, which would make dismantling difficult.

It is also an aim of the invention that all main parts in the system should be able to be made of aluminium profiles, and that no part should weigh more than 20 to 25 kg.

These and other aims can be achieved in the portable terrace installation of the invention by the joists being laid upon free-standing trestles, with each seating beam pillar being fitted, on the side which is turned towards the seating beam, with a first connecting element running essentially vertically along the side with its length being essentially as long as the height of the seating beam or longer, with the height of the seating beam being greater than its width, with each one of the ends of the seating beam being fitted with a second, essentially vertical connecting element linking with the aforementioned first connecting elements, with is span in the vertical direction being essentially as great as the height of the seating beam, with the aforementioned first and second connecting elements being so arranged that the seating beams can be connected together with the seating beam pillars through the seating beams being lowered between the seating beam pillars with successive joining of the two connecting elements without a wedge effect between these and through the aforementioned second connecting element including a sideways extending vertical waist member, which terminates in a widened portion which prevents the elements from coming apart from each other owing to tractive forces in the seating beams and/or sideways stresses on the seating beam pillar or joist.

The two joists can be parallel or converge in the same direction as they slope. In the latter case the section has the shape of a piece of cake. The sections can also be combined into larger coherent systems, when the stability is further increased. In this case two neighbouring sections have common joists. It is also possible to combine straight sections and ones shaped like a piece of cake with the same type of first and second connecting elements.

The further aims of the characteristics and aspects of the invention can be seen from the following claims and also from the following description of a preferred embodiment.

BRIEF DESCRIPTION OF THE DRAWINGS

In the following discription of a preferred embodiment reference will be made to the attached drawings, of which FIG. 15 shows a seat which is fitted with a fastening shown in FIG. 10.

DESCRIPTION OF PREFERRED EMBODIMENT

Figure 1:
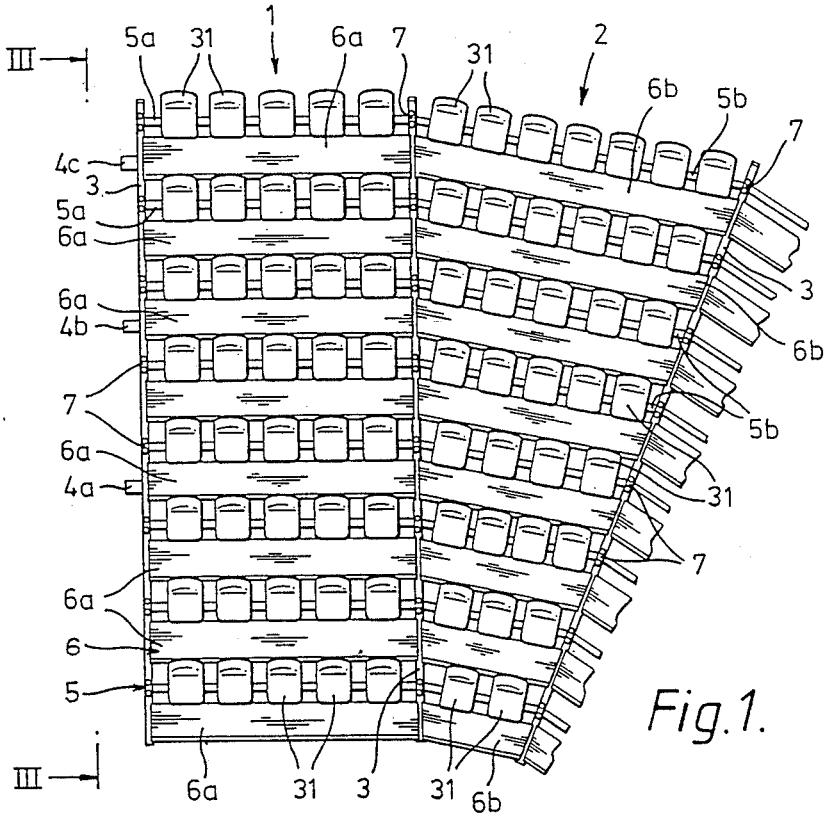
FIG. 1 shows, from above, a gradin system consisting of several sections, FIG. 2 constitutes a perspective view of a straight gradin section.

The gradin system shown in FIG. 1 consists of a straight section 1 and a number of tapering sections or ones shaped like a piece of cake 2. Each section 1 and 2 is limited by two sloping joists 3. Adjacent sections 1 and 2 have a common joist 3. The angle of slope is 7°. Each joist 3 is supported by three trestles 4*a*, 4*b*, 4*c*. Between the joists 3 stretches partly a number of seating beams 5, such as the seating beams 5*a* and 5*b* in sections 1 and 2 in FIG. 1 and, partly a number of walkways 6, such as the walkways 6*a* and 6*b* in the same sections. The seating beams 5, 5*a*, 5*b* are mounted on vertical seating beam pillars 7 on the joists 3. In the seating beam pillars 7 there are also mounted the railings 8, FIGS. 2 and 3. At the front end each joist 3 is also supported by a rubber heel 9. Seats 31 are mounted on the seating beams.

Figure 2:
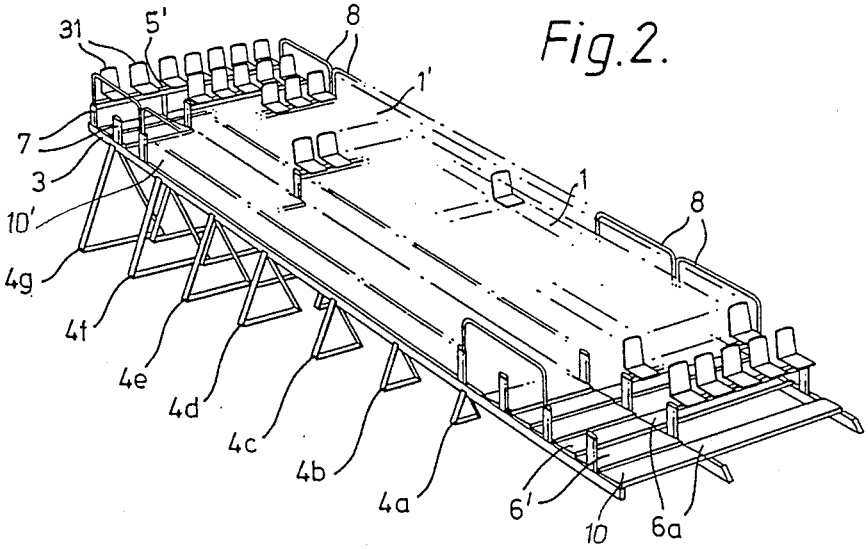
Figure 3:
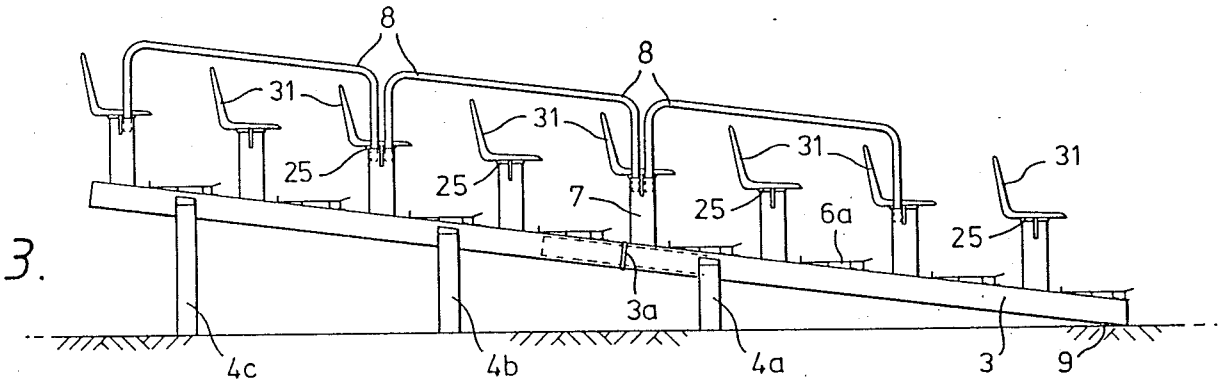
FIG. 3 shows a section from the side in a view III—III in FIG. 1, FIG. 4 constitutes a perspective view which explains how the main parts making up the system are connected to each other.

According to the embodiment rows of benches go into each section 1 and 2. Several such sections can be arranged one after the other. In FIG. 2 two straight sections 1 and 1' are shown arranged so that they form a 16-row section system. The rear section 1' is here supported by four trestles 4*d*–*g* with changing height and width. In addition it is shown in FIG. 2 how a pair of narrow sections 10 and 10' form a stair consisting of walkways 6' arranged like a flight of steps close behind each other. These walkways 6' have the same form as the walkways between the rows of benches. The distance between the rows of benches is the same width as a walkway 6. At the end of the stairway 10, 10' a seating beam 5' can also be arranged with a further pair of seats 31.

The joists 3 consist of aluminium extruded, jointed square tubes. The position of one joint has been designated 3*a* in FIG. 3. The upper side of the joists have along each edge an edge list 12. On the surfaces of the joists 3 which are not taken up by the seating beam pillars 7 there are laid rubber mats 13 which fill up the surface between the edge lists 12. The rubber mats 13 are somewhat thicker than the height of the edge lists 12, so that they project over the latter in order to provide a base for the bearing surfaces 6, 6*a*, 6*b*, or the stairway 6', FIG. 2. On the upper side of the joists 3 there are also lugs 14 combining with notches 15 in the bearing surfaces in order to anchor these.

The seating beam pillars 7 are made of extruded aluminium tubes. They are cut off obliquely at the bottom end (7° oblique cut) and fixed to the upper side of the joists 3 by welding, so that they stretch vertically upwards. The cross sectional profile can be seen from FIG. 6. As shown in this figure the seating beam pillars 7 have in cross section the shape of a continuous oval with two parallel, straight long sides 17 and two circularly rounded short ends 18. The rounding of the short ends 18 continues with circularly bent parts 19 in the interior of the pillar. The circularly bent parts 18 and 19 form at each end of the seating beam pillar 7 a circular area 20 for the anchoring of the railings 8, FIGS. 2 and 3. The central parts 21 of the straight sides of the seating beam pillars 7 are strengthened through a greater thickness of material. In these parts, that is to say on each long side of the seating beam pillars 7, there is a vertical slot 22 running straight through it, which is included in the aforementioned first connecting element for the seating beams 5, 5*a*, 5*b*. The length of the slot 22 is the same as the height of the seating beams 5, 5*a*, 5*b*.

Figure 7:
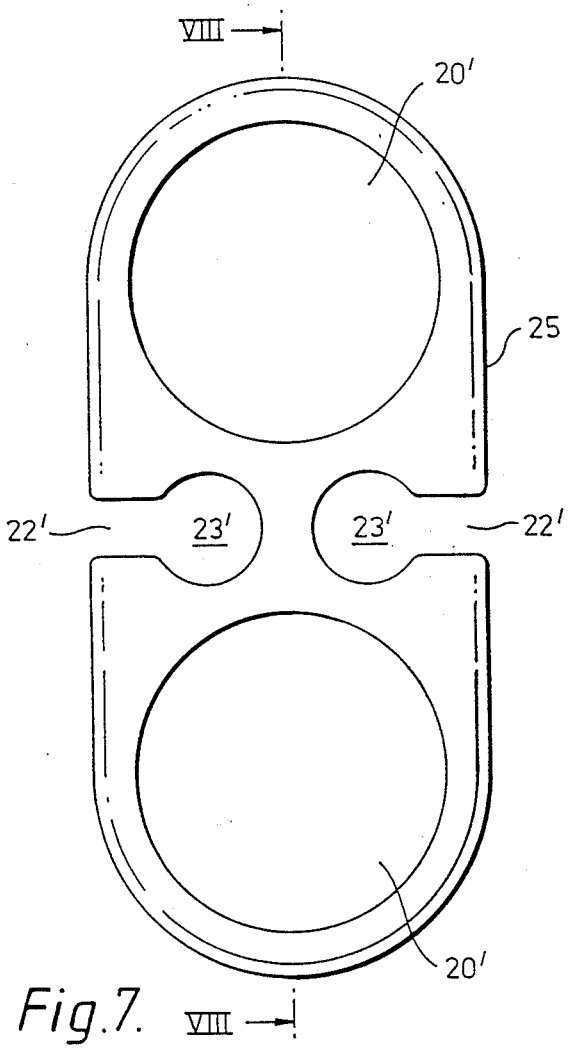
FIG. 7 shows in a plan view the cover as per FIG. 4A on a larger scale FIG. 8 constitutes a section VIII—VIII in FIG. 7, FIG. 9 constitutes a side view of the two ends of the seating beam, with the aforementioned second connecting elements inserted into the ends, according to the first version, FIG. 10 constitutes a vertical section X—X in FIG. 9 and also shows a fastening for a seat, FIG. 10A constitutes an axial section through the fastening on a larger scale, FIG. 11 constitutes a horizontal section through a second embodiment of a fastening element for joining a seating beam to the seating beam pillar in a straight gradin section, FIG. 12 constitutes a corresponding section through a connecting element for a tapering or otherwise slanting gradin section, FIG. 13 constitutes a side view of the two ends of the seating beam with the connecting elements as in this second version inserted in the ends, FIG. 14 constitutes a view XIV—XIV in FIG. 13.
Figure 8:
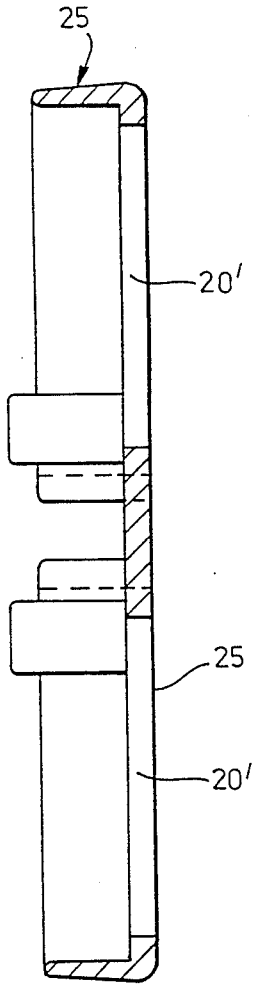

The seating beam pillars 7 are covered with plastic covers 25, FIGS. 7 and 8, which can be pressed down in the pillars. In the covers there are circular holes 20' corresponding to the areas 20 in the pillars 7. Further there is on each long side a cut-out 22' corresponding to the slot 22. The cut-out 22' is terminated with a circular area 23'.

Figure 10A:
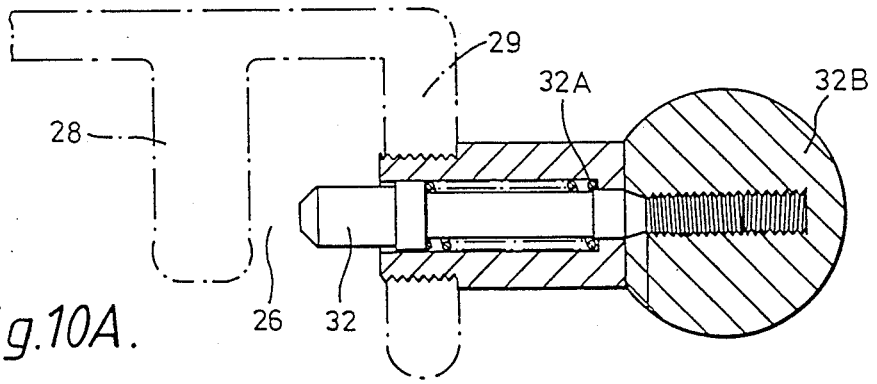
Figure 14:
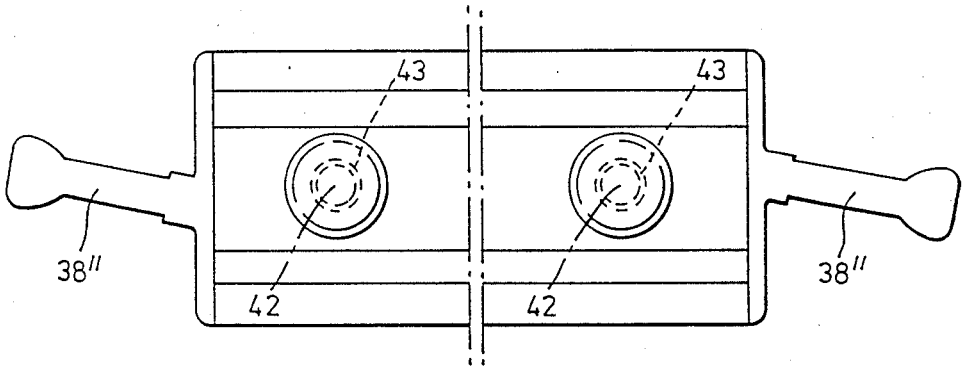

The seating beams 5, 5*a*, 5*b* consist like the joists 3 of extruded aluminium box spars. The height is essentially greater than the width in order to give the required bending moment in the vertical direction. On the upper side there are two longitudinal cut-outs 26 and on the outer side near the upper edge longitudinal cut-outs 27. The cut-outs 26 are intended to be able to receive two shanks 28 on a bracket 30 on the underside of a seat 31, FIG. 15. Further there is on the bracket 30 a shank 20 with a horizontal spring-loaded pin 32, FIG. 10A, intended to snap into one of the slots 27 in order to anchor the chair 31 on the seating beams. On each seating beam 5, 5*a*, 5*b* there is a number of such chairs 31 mounted, which occupy the available area on the beam. When mounting the chair on the seating beam it is not necessary to push in the pin 32. It finds its own way in to the slot 27, since it is tapered to the front. When the chair is to be released, the ball 32B is pushed, so that the pin 32 under the counteraction of the spring 32A can leave the slot 27.

Figure 6:
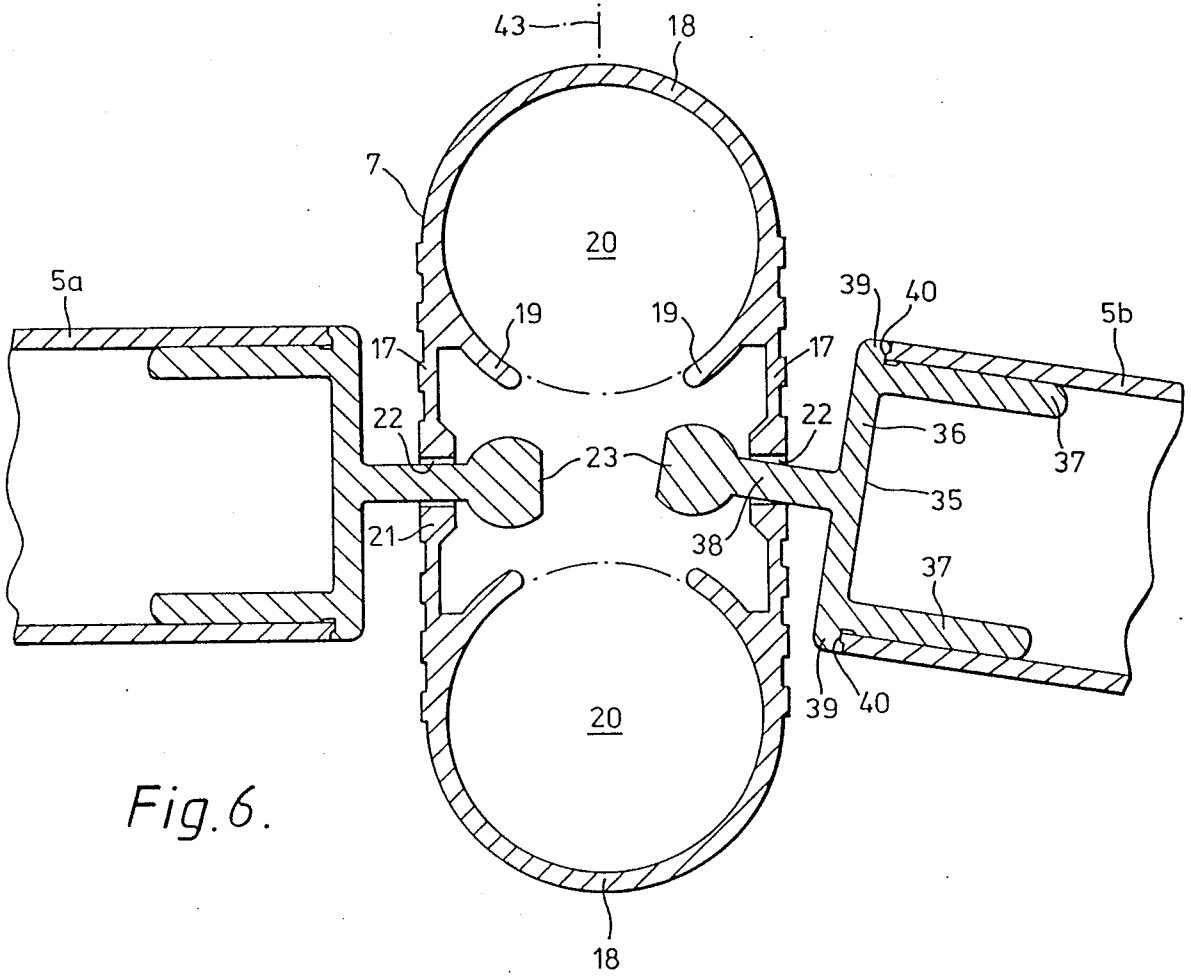
FIG. 6 shows through a horizontal section through the upper part of the seating beam pillar together with adjacent parts of a pair of seating beams connected to the pillar how the seating beams are joined to the pillar according to a first embodiment.

The second connecting element mentioned in the introduction consists according to a first version, which is shown in FIG. 6, of a profile element 35 which has the form of a fork with a base 36 with two shanks 37 going out from the base in one direction and a central waist member 38 going out from the base 36 in the other direction which terminates with a widened portion 23. The base 36 is terminated at each end by a edge projection 39. The profile element 35 is also made of extruded aluminium. Each such profile element 35 consists of a cut off piece, whose length is the same as the inner height of the seating beams 5, 5*a*, 5*b* up to the material under the cut-out 26, that is to say it has a length corresponding to the distance A in FIG. 10. Each seating beam 5, 5*a*, 5*b* is fitted at each end with an element 35, whose shanks 37 are inserted to the maximum in the seating beam, that is to say that the edge projections 30 on the element 35 push against the ends on the vertical end surfaces 40 of the seating beams, FIGS. 6, 9 and 10. The elements 35 are afterwards welded on the upper side and the underside, so that they are firmly anchored in the seating beams 5, 5a, 5b. The welds are marked 41.

Figures 4, 4A:
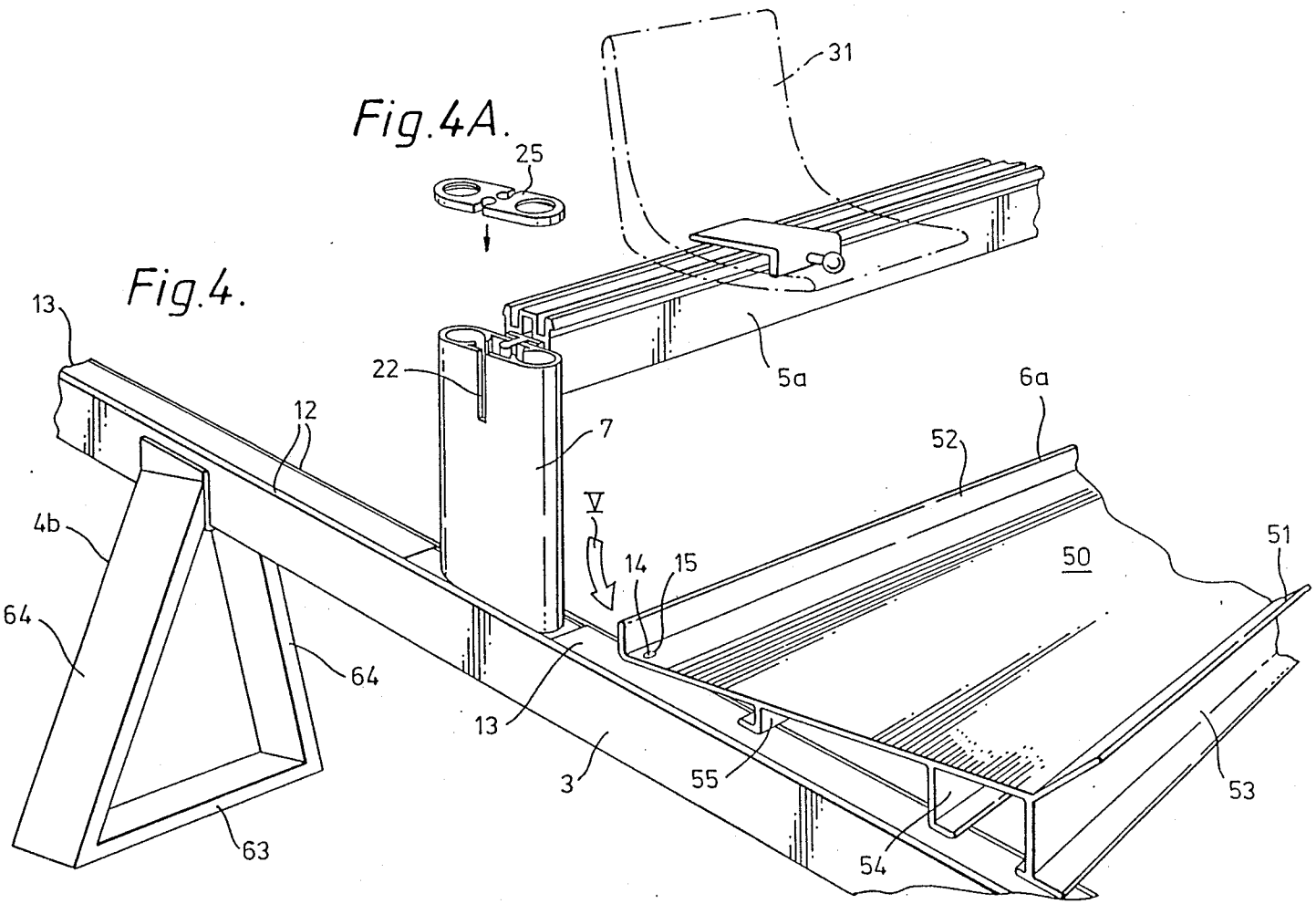
FIG. 4A shows a cover for the seating beam pillar, FIG. 5 makes clear through a view in the direction of the arrow V how a walkway is connected to the joist.

The widened portion 23 at the end of the waist member 38 has a cross section in the form of a cut off circle, whose diameter is somewhat less than the circular cut-out 23' in the plastic cover 25. The thickness of the waist member 38 is somewhat less than the slot 22 in the seating beam pillar 7 and the cut-out 22' in plastic cover 25, so that the seating beam 5, 5a, 5b can be lowered between two seating beam pillars 7 with the waist member 38 running in the slot 22 till its member 38 comes up against the bottom of the slot. The width of the slot 22 is again so much greater than the thickness of waist member 38 that the seating beam, like seating beam 5b in FIG. 6, can twist to a certain angle relative to the axis of symmetry 43 of seating beam pillar 7 without thereby preventing the possibility of joining up of seven sections shaped like a piece of cake, FIG. 1. The widened portion 23 at the end of the member 38 constitutes a safety device which prevents the seating beam from coming adrift from the slot 22 by reason of extraordinary stresses. Normally, however, the swelling 23 does not lie against the inside of the seating beam pillar 7. For maintenance of the connection the friction between waist member 38 and the bottom of the slot 22 is fully sufficient, especially as the friction force increases when the seating beam is loaded. FIG. 4 illustrates how a seating beam 5a tends to drop with its waist member 38 into the one slot in a seating beam pillar 7. The figure shows seating beam 5a in a position where it has not been fully brought down. In the figure cover 25, FIG. 4a has been removed in order to make the various details visible. But in reality the cover 25 sits firmly on the seating beam pillar the whole time, with the waist member 38 and the widened portion 23 dropping down through corresponding cut-outs 22' and 23' in the cover, FIG. 7.

FIG. 11 illustrates an alternative embodiment of the aforementioned connecting element 35, which is in the form of a fork. This connecting element is intended to join together the seating beams in a straight section 1 and the seating beam pillars 7. In FIG. 12 there is shown a slightly modified connecting element 35'' for joining of the seating beams in a tapering section 2 and the seating beam pillars. The elements which have a direct correspondence to the element 35 as per the first version have been given the same respective designations as in FIG. 6 but with the addition of a single stroke or a double stroke for the waist member 38'' in the connecting element 35''. In the versions as per FIG. 11 and FIG. 12 a pair of arms 45 extend inwards towards each other at right angles to the shanks 37'. The point that is the foot of each arm 45 on the respective shanks 37' lies in a short way from the end of the shank 37'. Each arm 45 terminates in the arc of a circle 41. The arcs of a circle 41 have a common centre 42, which coincides with a plane of symmetry of element 35', or a central plane of the connecting element 35''. In the middle of this centre 42—when the connecting element 35' or 35'' is inserted in the ends of a seating beam 5—there is a hole 43 in the underside of the seating beam, FIG. 13. In each one of these holes 43 a peg 44 has been driven in. The peg 44 is thicker than the space between the arcs of a circle 41, i.e. the radius of the peg is greater than the internal radius of the arcs of a circle 41. Through forcefully knocking in the peg 44 the arcs of a circle 41 are therefore driven apart from each other. The outward pressure force is transferred via the arms 40 to the shank 37', so that these are pressed with their outer sides against the inside of the seating beam. The connecting elements 35' or 35'' can in this way be permanently anchored in the seating beams through a friction joint, whereby welding can be avoided.

Figure 5:
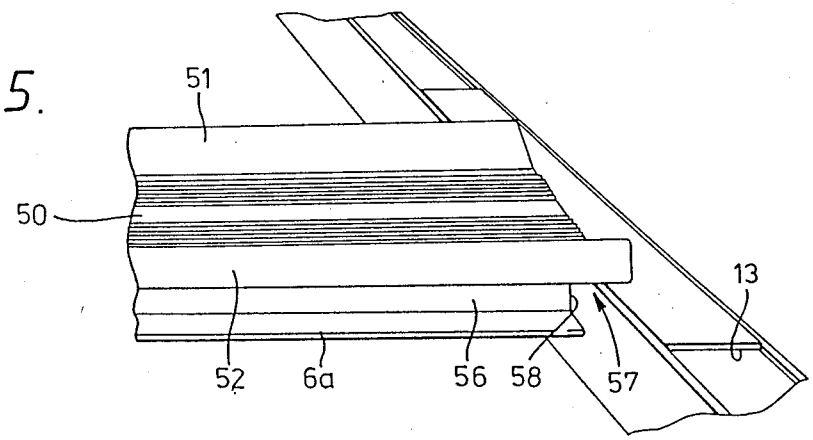
Figure 19:
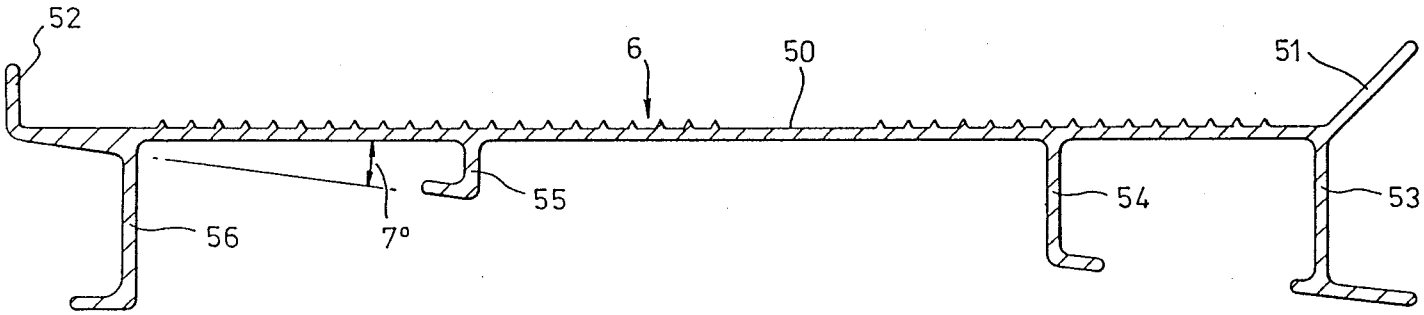

The walkways 6, 6a, 6b, FIGS. 4 and 19, like the stair 6', have a flat serrated top side 50 which is limited at the front by a toe board 51 and at the back by a back edge 52. On the underside there are four flanges, which are designated counting from the front 53, 54, 55 and 56. The first three flanges 53, 54 and 55 rest with their end parts on the rubber mat 13 on the two joists 3. The rear flange 56 is on the other hand cut off at the end at 57, FIG. 5. The cut off end lies with its end surface 58 against or lies near the side 59 of the joist 3 which is turned towards the walkway. In each of the two rear corners the top side 50 of the walkway has a round, fairly large cut-out 15 for the corresponding lug 14 on the top side of the joist 3.

Figure 17:
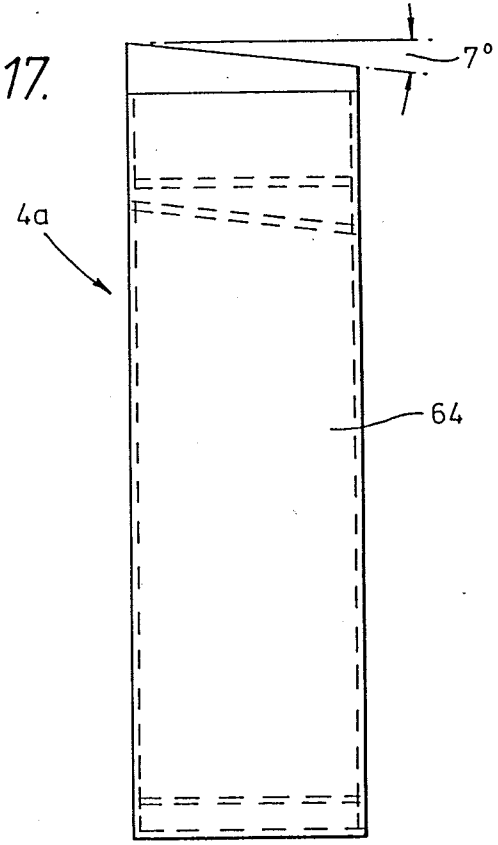
FIG. 17 is a vertical section XVII—XVII through the trestle in FIG. 16.
Figure 16:
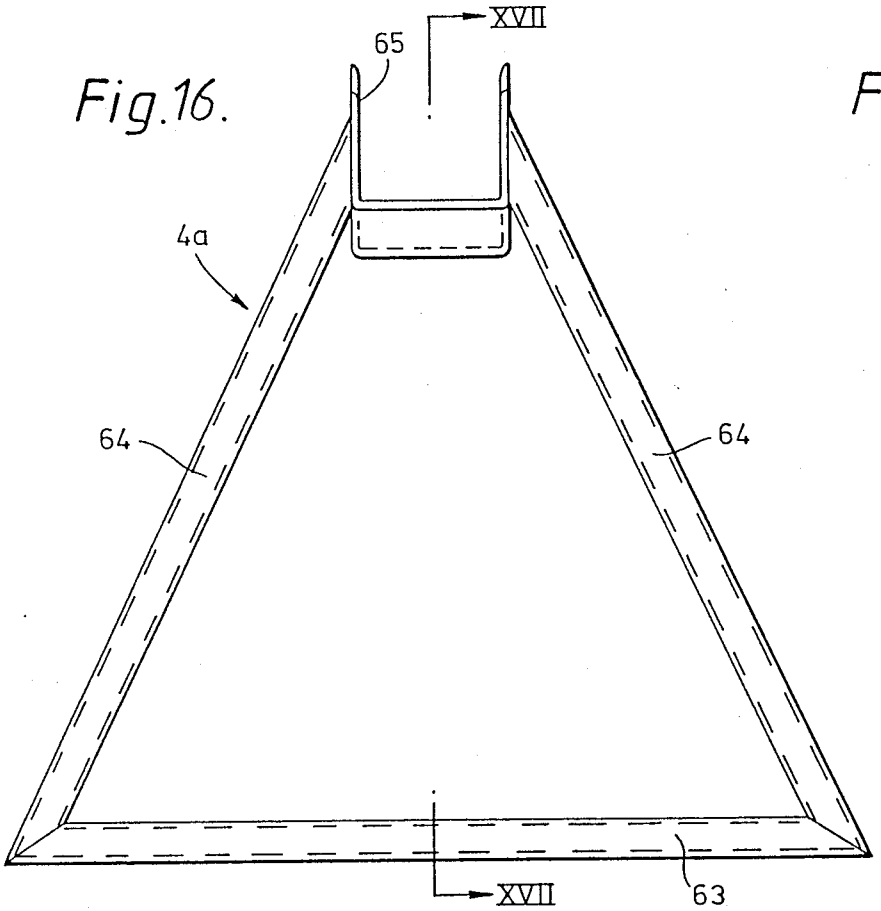
FIG. 16 shows a trestle seen in the direction of the joist.
Figure 18:
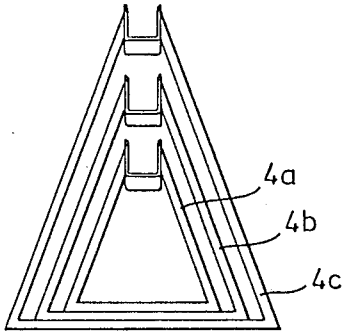
FIG. 18 shows three trestles stacked into each other in transport storage position, and FIG. 19 constitutes a cross section through a walkway.

The trestles 4a–g each consist of three beams, namely a bottom beam 63 and two inward sloping side beams 64. The latter two extend upwards to a transverse sloping U beam 65 open at the top, FIG. 16 and FIG. 17. The bottom of the U beam 65 has the same slope as the joists 3, that is to say 7°. The width of the U beam 65, that is to say the distance between the vertical sides, is the same as the thickness of the joist 3. The trestles 4a–g are free standing, that is to say they can be placed on a base and stand up without support, provided that the base is approximately flat. The joists 3 are placed in the beams 65, then the trestles are placed at a suitable distance from each other. If the base is uneven a correction of the position of the trestles may be necessary, which is easy to carry out by moving the trestle forwards or backwards. If the base slopes somewhat to the side, this can be tolerated, since the member 38, FIG. 6, has a sufficient length to compensate for moderate unevennesses or slope conditions in the base. If for example the trestles 4a–g slope somewhat to the side the joist 3 and the seating beam pillar 7 belonging to it also come to slope to a corresponding degree, which slope is compensated by a corresponding displacement of the member 38 in the slot 22 relative to an assumed normal position. When the tier system is loaded with spectators the side beams 64 of the trestles tend to bend inwards whereby the joists 3 are clamped firmly between the side shanks of the beam 65 so that self-locking is obtained. The trestles 4a–g consist, like the rest of the system, of aluminium profiles and can be stacked in each other, as shown in FIG. 18, whereby the requirement for transport and storage space is minimised.

We claim:

1. A portable terrace installation with seats, including one or more sections, each section comprising:

a pair of sloping joists;

a number of upright seating beam pillars connected to said sloping joists;

a corresponding number of parallel and horizontal seating beams connected to said beam pillars and extending between opposite beam pillars on said pair of joists, each seating beam having opposite ends and having a height which is greater than its width, each said beam pillar having a side facing said seating beam;

a flat floor surface extending between said seating beams and connected to said joists;

a number of free standing trestles for supporting said joists;

a first connecting element provided on said side of said beam pillar facing said seating beam, said first connecting element extending essentially vertically along said side, said first connecting element having a length essentially as long as the height of said seating beam or longer, said first connecting element comprising a female member open at an upper end thereof, said female member being terminated by a support surface;

a second connecting element connected to each end of said seating beam and being essentially vertical, said second connecting element comprising a male member having a height essentially the same as the height of said seating beam, said first and second connecting elements being connectable to join a seating beam with opposite beam pillars without a wedge effect between said male and female members until said male member rests against said support surface of said female member, said male member including a sideways extending waist member terminating with a widened portion for preventing said seating beam and said beam pillar from separating from each other due to tractive forces on said seating beam or sideways effects on said beam pillars or said joists.

2. Installation according to claim 1, wherein said trestles have a U-shaped cut-out for said joist, the vertical sides of said U-shaped cut-out being arranged to lock round vertical sides of said joist when said joist is subjected to loading so that said joist locks itself in said trestle.

3. Installation according to claim 1, wherein said seating beam pillars have at each of their ends annular circular spaces for mounting railings.

4. Installation according to claim 1 and further including walkways having a flat top and an underside, and stiffening flanges on said underside, at least some of said stiffening flanges resting with their end parts on a top side of said joists, at least some said stiffening flanges having a stop face turned towards vertical inner sides of said joists.

5. Installation according to claim 1, wherein the interval between the walkways is as wide as the width of the walkways.

6. Installation according to claim 5, wherein at least one stairway section extends into at least one section which is provided with seating beams, seats and walkways, said at least one stairway section having stairs of essentially the same construction as said walkways, said stairs covering a space between a pair of joists.

7. Installation according to claim 1, wherein said first connecting element comprises a slot along said side of said seating beam pillar, said slot having a width, said waist member having a thickness less than said width of said slot, wherein said waist member can twist to a certain angle in said slot relative to a longitudinal direction of said joist.

8. Installation according to claim 7, wherein said waist member is essentially as thick as said width of said slot, said waist member extending in the same direction of said seating beam in order to connect said seating beam at right angles to a joist.

9. Installation according to claim 7, wherein said waist member extends at an angle relative to said seating beam to make an oblique connection of the said seating beam to said joist.

10. Installation according to claim 7, wherein said seating beam pillar is tubular with a cross-section extending in the same direction as the corresponding joist.

11. Installation according to claim 7, wherein said slot in said side of said seating beam pillar is essentially as long as the height of said seating beam.

* * * * *